US006333984B1

(12) United States Patent
Yang

(10) Patent No.: US 6,333,984 B1
(45) Date of Patent: Dec. 25, 2001

(54) CLIP-TYPE MICROPHONE

(75) Inventor: Tony Yang, Taichung (TW)

(73) Assignee: Sekaku Electron Industry Co., Ltd., Taichung (TW)

( * ) Notice: Subject to any disclaimer, the term of this patent is extended or adjusted under 35 U.S.C. 154(b) by 0 days.

(21) Appl. No.: 09/672,300

(22) Filed: Sep. 29, 2000

(51) Int. Cl.[7] ..... H04R 25/00
(52) U.S. Cl. ..... 381/364; 381/375
(58) Field of Search ..... 381/364, 374, 381/375, 385; 181/22

(56) References Cited

U.S. PATENT DOCUMENTS 3,928,734 * 12/1975 Noury, Jr. ..... 381/364
6,178,251 * 1/2001 Luchs et al. ..... 381/364
6,201,877 * 3/2001 Chang ..... 381/364

* cited by examiner

*Primary Examiner*—Khanh Dang
(74) *Attorney, Agent, or Firm*—Browdy and Neimark

(57) ABSTRACT

A clip-type microphone comprises a main rod, a first clip set fastened with the main rod, a second clip set fastened with the main rod, an extension rod fastened with one end of the main rod, and a head fastened with one end of the extension rod. The head of the microphone is located in proximity of the mouth of a user of the microphone. The main rod is fastened to the garment of the user of the microphone such that the clip sets hold a specific part of the garment of the microphone user.

10 Claims, 5 Drawing Sheets

CLIP-TYPE MICROPHONE

FIELD OF THE INVENTION

The present invention relates generally to a microphone, and more particularly to a clip-type microphone.

BACKGROUND OF THE INVENTION

As shown in FIG. 1, a prior art clip-type microphone is designed for use in such a manner that the microphone is attached to the garment of a user of the microphone.

As shown in FIG. 2, another prior art clip-type microphone is designed for use in such a manner that the microphone is attached to the collar of the apparel of a user of the microphone. The attaching of the microphone to the apparel collar is inconveniently done in conjunction with a mirror.

As shown in FIG. 3, a hand-held microphone of the prior art must be held constantly with hand of a user of the microphone. The holding of the microphone with hand for a long period of time can be rather tiresome.

SUMMARY OF THE INVENTION

The primary objective of the present invention is to provide a microphone free of the deficiencies of the prior art microphones described above.

The present invention comprises a main rod, a first clip set disposed on the main rod, a second clip set disposed on the main rod, an extension rod fastened with an upper end of the main rod, and a head fastened with the top end of the extension rod. The microphone can be easily attached to any part of the garment worn by a user of the microphone, thanks to the first clip set and the second clip set.

DETAILED DESCRIPTION OF THE INVENTION

Figure 1:
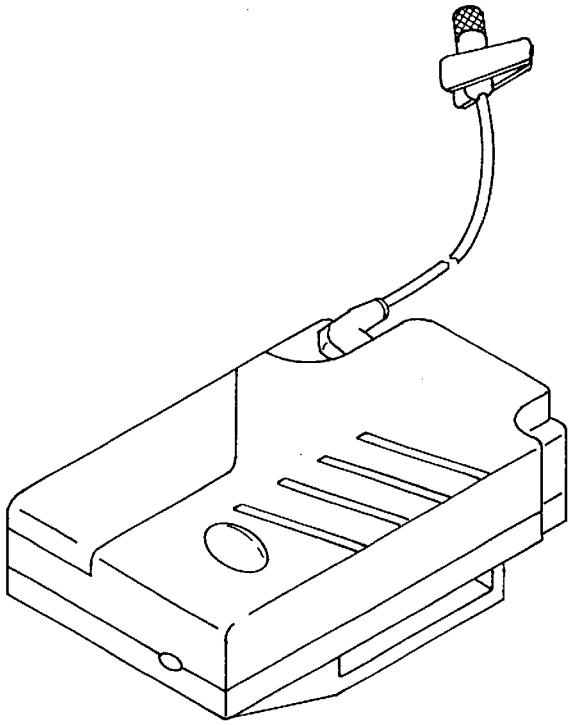
FIG.1 PRIOR ART
FIG. 1 shows a schematic view of a prior art clip-type microphone.
Figure 2:
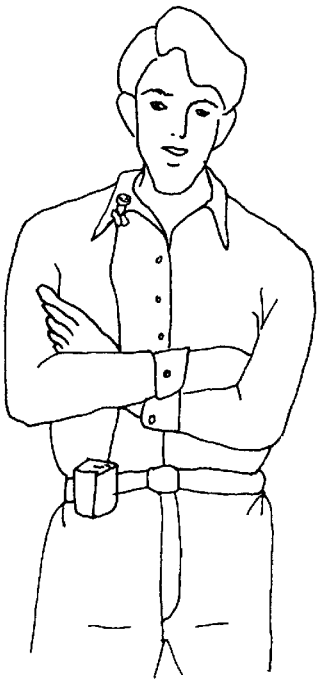
FIG.2 PRIOR ART
FIGS. 2 and 3 are schematic views of the prior art clip-type microphone in use.
Figure 3:
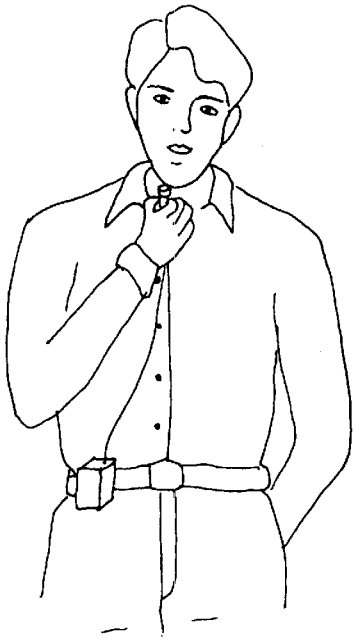
FIG.3 PRIOR ART
Figure 4:
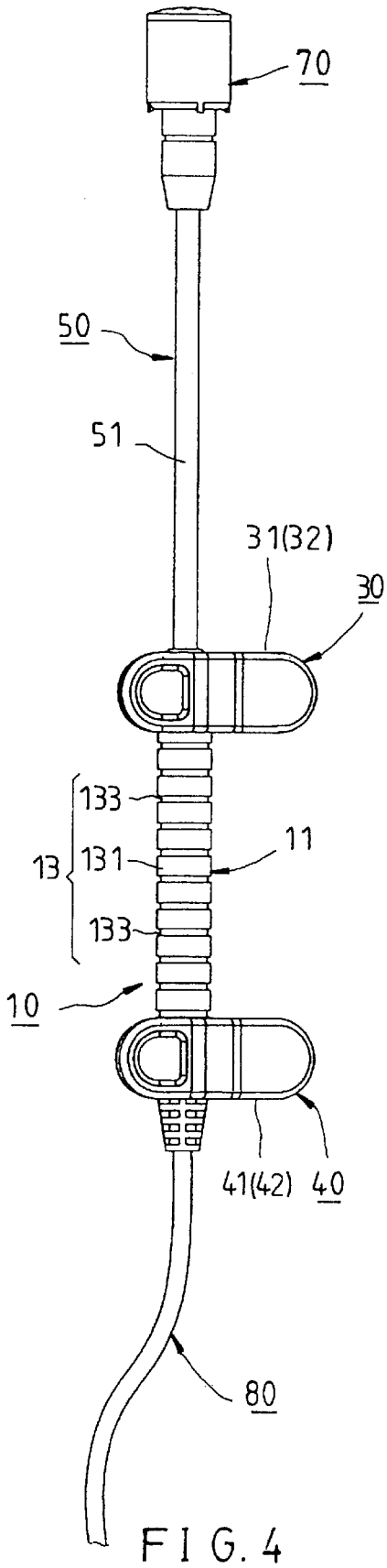
FIG. 4 shows a schematic plan view of a preferred embodiment of the present invention.
Figure 5:
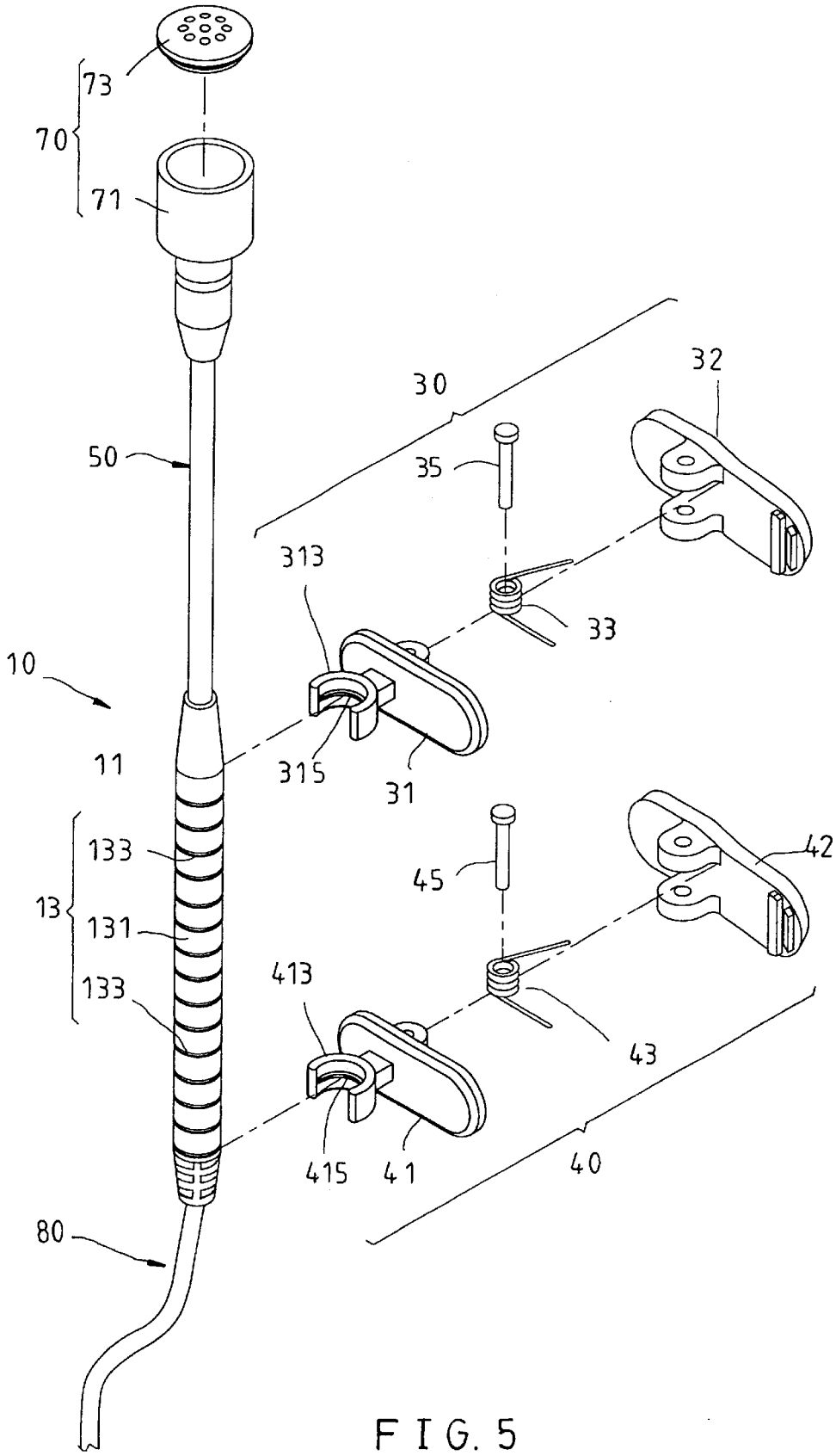
FIG. 5 shows an exploded view of the preferred embodiment of the present invention.
Figure 6:
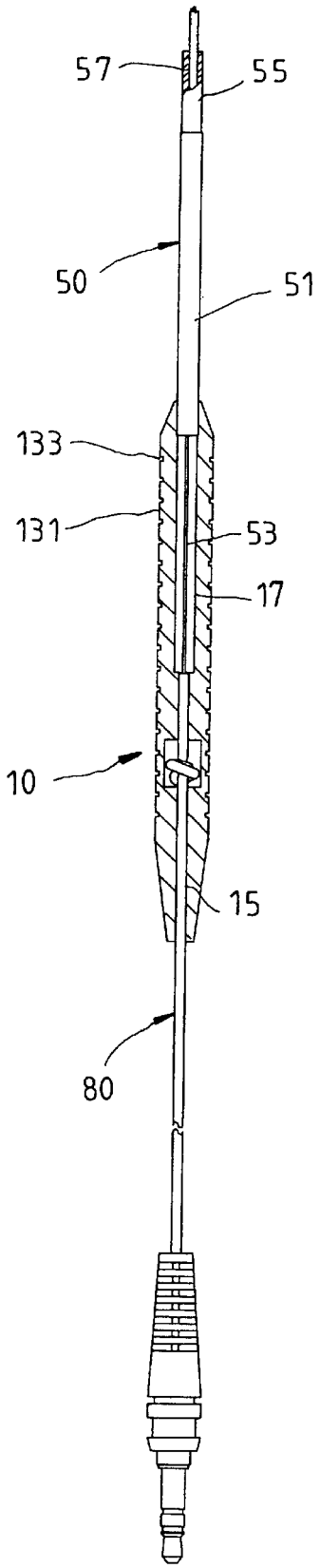
FIG. 6 shows a sectional view of the preferred embodiment of the present invention in combination.

As shown in FIGS. 4–6, a microphone 1 embodied in the present invention comprises a main rod 10, a first clip set 30, a second clip set 40, an extension rod 50, and a head 70.

The main rod 10 has a rod body 11, a fastening segment 13 provided with a plurality of continuous ridges 131 and grooves 133, a cord hole 15, and a connection portion 17.

The first clip set 30 is disposed on an upper end of the main rod 10 and is formed of two clip pieces 31 and 32, a torsion spring 33, and a pivot 35. The clip piece 31 is provided with a fitting portion 313 of an arcuate construction for fitting over the fastening segment 13 of the main rod 10 such that a retaining ring 315 is formed in the inner edge of the fitting portion 313. The retaining ring 315 is retained in the groove 133, thereby enabling the clip pieces 31 and 32 to be fastened to the garment worn by a user of the microphone 1 of the present invention.

The second clip set 40 is disposed on the lower end of the main rod 10 and is formed of two clip pieces 41 and 42, a torsion spring 43, and a pivot 45. The clip piece 41 is provided with a fitting portion 413 of an arcuate construction for fitting over the fastening segment 13 of the main rod 10 such that a retaining ring 415 is formed in the inner edge of the fitting portion 413. The retaining ring 415 is retained in the groove 133, thereby enabling the clip pieces 41 and 42 to be fastened to the garment of a user of the microphone 1 of the present invention.

The extension rod 50 is made of a pliable material and is provided with a rod body 51 having a rod connecting portion 53, a head connecting portion 55, and a guide hole 57.

The head 70 is disposed at the top end of the extension rod 50 for receiving the voice and is provided with a seat 71 fastened with the rod body 51 having a rod connecting portion 53, a head connecting portion 55, and a guide hole 57.

The head 70 is disposed at the top end of the extension rod 50 for receiving the voice and is provided with a seat 71 fastened with the rod body 51 of the extension rod 50, and a voice receiving cover 73 which is joined with the seat 71 such that a cord 80 of the receiver (not shown in the drawings) is connected with the microphone main unit via the guide hole 57 of the extension rod 50 and the cord hole 15 of the main rod 10.

Figure 7:
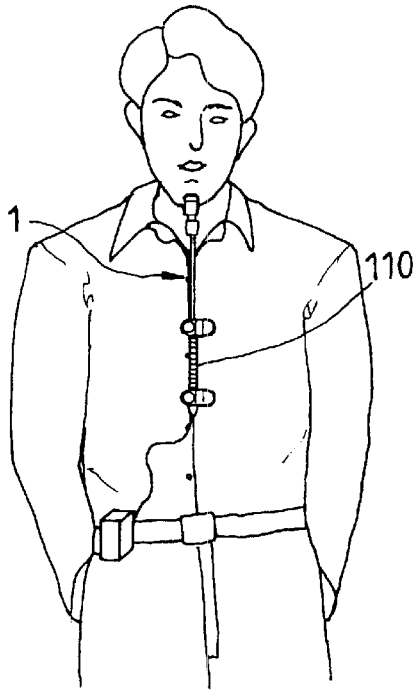
FIGS. 7, 8, and 9 are schematic views of the present invention in use.

As shown in FIG. 7, the microphone 1 is fastened to the garment of a user of the microphone 1 such that the first clip set 30 and the second clip set 40 are securely held to a side edge 110 of the garment of the user of the microphone 1, without the help of a mirror.

Figure 8:
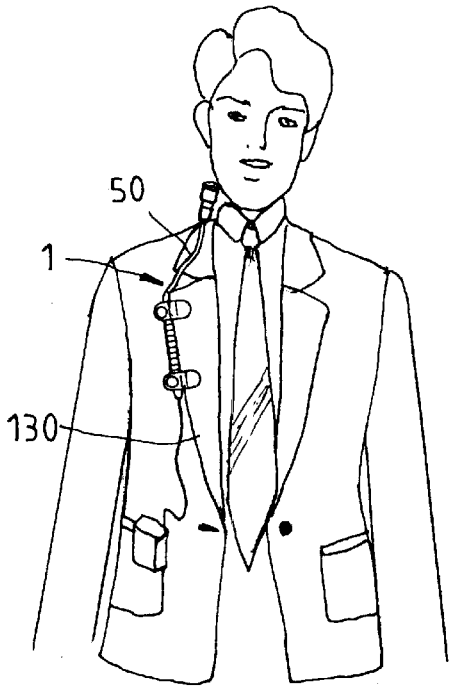

As shown in FIG. 8, in light of the extension rod 50 being arcuate, the microphone 1 can be held to a lapel 130 of the jacket such that the head 70 is located in proximity of the mouth of a user of the microphone 1.

Figure 9:
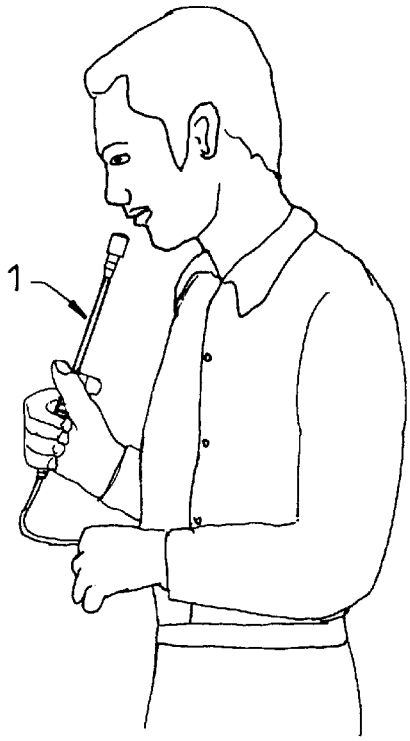

As shown in FIG. 9, the microphone 1 of the present invention is held by the hand of a user such that the main rod 10 or the clip sets 30 and 40 serves as a grip for holding the head 70 close to the mouth of the user.

What is claimed is:

1. A microphone comprising:

a main rod;

a first clip set fastened to said main rod;

a second clip set fastened to said main rod;

an extension rod fastened with one end of said main rod; and a head mounted on one end of said extension rod;

said head being located in proximity of the mouth of a user of said microphone such that said first clip set and said second clip set are fastened to the garment of the user.

2. The microphone as defined in claim 1, wherein said main rod is provided with a fastening segment which is provided with a plurality of ridges and grooves.

3. The microphone as defined in claim 1, wherein said main rod is hollow to enable a cord to extend therethrough.

4. The microphone as defined in claim 1, wherein said extension rod is hollow to enable a cord to extend therethrough.

5. The microphone as defined in claim 1, wherein said main rod is made of a pliable material.

6. The microphone as defined in claim 1, wherein said extension rod is made of a pliable material.

7. The microphone as defined in claim 1, wherein said clip sets are provided with a fitting portion whereby said fitting portion is fitted over said main rod.

8. The microphone as defined in claim 7, wherein said clip sets are provided with a retaining ring in contact with said main rod.

9. The microphone as defined in claim 8, wherein said main rod is provided with a plurality of annular grooves; wherein said retaining ring is retained in any one of said annular grooves of said main rod.

10. The microphone as defined in claim 1, wherein said clip sets are formed of two clip pieces, a torsion spring, and a pivot.

* * * * *